United States Patent [19]

St. Louis

[11] Patent Number: 4,628,617

[45] Date of Patent: Dec. 16, 1986

[54] CRIMPED DRIER DRUM STRUCTURE

[75] Inventor: Robert M. St. Louis, St. Leonard, Canada

[73] Assignee: Camco Inc., Weston, Canada

[21] Appl. No.: 729,042

[22] Filed: Apr. 30, 1985

[30] Foreign Application Priority Data

Jun. 20, 1984 [CA] Canada ..... 457041

[51] Int. Cl.[4] ..... F26B 11/02

[52] U.S. Cl. ..... 34/108; 34/133; 34/242

[58] Field of Search ..... 34/108, 121, 133, 242; 220/309, 310; 413/4, 26

[56] References Cited

U.S. PATENT DOCUMENTS 940,168 11/1909 LaFave ..... 220/309

1,355,918 10/1920 Schroeder ..... 220/309

1,514,930 11/1924 Reynolds ..... 220/309

1,527,897 2/1925 Mittenger ..... 220/309

3,066,422 12/1962 Douglas ..... 34/133

3,483,632 12/1969 Triplett ..... 34/133

*Primary Examiner*—Albert J. Makay

*Assistant Examiner*—David W. Westphal

[57] ABSTRACT

A drum for a clothes drier formed from a cylindrical sleeve into which is inserted a pair of opposed head structures, each provided with a seat snugly received in the adjacent end of the sleeve and terminated by an abutment to limit the penetration of the head into the sleeve. Axially extending projections are provided at each end of the sleeve and these projections are bent around their adjacent seats thereby to hold the heads and sleeve together.

5 Claims, 4 Drawing Figures

CRIMPED DRIER DRUM STRUCTURE

FIELD OF THE INVENTION

The present invention relates to a drier drum particularly suitable for a clothes drier wherein the drum and heads are secured together by crimped tabs.

BACKGROUND OF THE INVENTION

In the manufacture of domestic clothes drier, the drum is normally formed from a pair of opposed heads with a substantially cylindrical sleeve extending there between. Substantially cylindrical seats on the head are snugly received in the sleeve and the sleeve is then welded to each of the heads to form a unitary structure composed of a sleeve and the heads at each end thereof. The welding operation obviously requires heat even though in many cases a simple tack weld is used to secure the two devices together.

Obviously with the above system it is necessary that the head structures if they are to be painted or coated with any heat sensitive coatings be so painted or coated subsequent to the welding operation. Thus in any lines were, for example, the outer face of the head is to be painted it is necessary this painting operation take place after the welding operation. Similarly if the inside surfaces are to be coated with a porcelain enamel or the like, for example, this coating operation can only be performed after the welding has been completed.

In many cases it has been deemed desirable to prepaint or pre-coat the heads, however because of the manner in which the drum structure was constructed, this could not be done.

If welding is used on stainless steel heads discoloration may occur which require a subsequent operation to remove the discoloration.

Similarly, the fabricating operation where the tack welding is involved is more elaborated than what is necessary with the present invention since not only do the devices have to be assembled but they have to go through a tack welder in order to fix them together. With the present invention the assembly and securing may occur on the same apparatus.

BRIEF DESCRIPTION OF THE PRESENT INVENTION

It is an object of the present invention to provide a new drier drum structure wherein the heads and sleeve are assembled by a mechanical joint formed by deforming a portion of the sleeve.

Broadly in the present invention comprises a drum structure for a clothes drier comprising a cylindrical sleeve, a pair of opposed heads position one at each end of said sleeve, a circumferential axially extending seat on each of said heads, said seats being snugly received in said sleeve and an abutment means at the outer end of each of said seats to limit penetration of its respective said head into said sleeve, axially extending tabs projecting from each end of said sleeve and said tabs being bent around the seat on its adjacent of said heads to secure said sleeve to said heads.

BRIEF DESCRIPTION OF THE DRAWINGS

Further features, objects and advantages will be evident from the following detailed description of the preferred embodiment of the present invention taken in conjunction with the accompanying drawings in which.

DESCRIPTION OF THE PREFERRED EMBODIMENT

Figure 1:
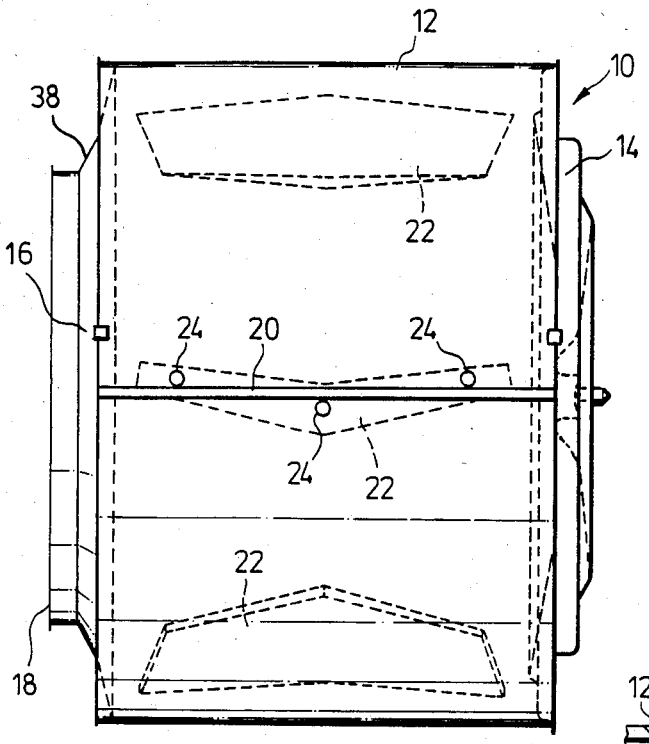
FIG. 1 is a side elevation of a drier drum constructed in accordance with the present invention.

As shown in FIG. 1, the drier drum 10 is formed from a substantially cylindrical sleeve 12 and a pair of heads 14 and 16, the head 14 being a rear head and the head 16 the front head or access head through which a hole is provided through the circular element 18 for access to the interior of the drum for insertion and withdrawal of the clothes.

The sleeve 12 of the instant invention may be formed from sheet metal. It is formed into a circular arrangement and suitably folded along each side so that a substantially standard sheet metal crimped or folded joint may be provided such as the type found in the conventional stove pipe to join the sides together. Such joint is indicated schematically at 20 and joints the sides of the sheet metal together to form the sleeve 12.

Figure 2:
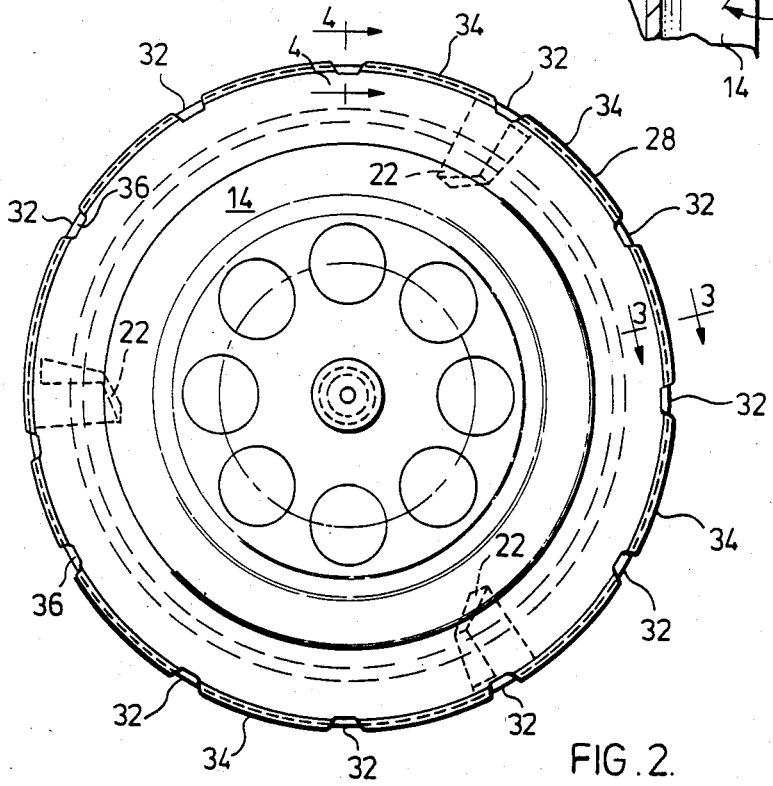
FIG. 2 is an end view of the drier drum looking towards the head from the right end of FIG. 1.

Suitable flights 22 shown in hidden lines in FIGS. 1 and 2 will be provided in a conventional manner. In the illustrated arrangement, one of the flights 22 is secured to the sleeve 12 via bolts 24 position on opposite sides of the seam 20 to further lock the sleeve in a cylindrical form.

Each of the heads 14 and 16 will be constructured in a similar manner to form the interconnection between the head and the sleeve 12. For this reason only the head 14 will be described in detailed, it is being understood that the head 16 will be similarly formed and secured.

Figure 3:
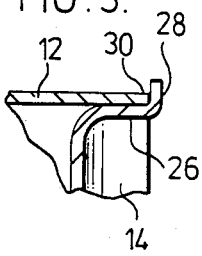
FIG. 3 is a sectional on line 3-3 of FIG. 2.
Figure 4:
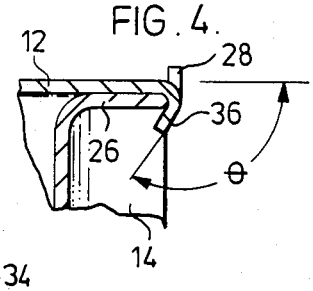
FIG. 4 is a sectional on line 4—4 of FIG. 2.

As shown in FIGS. 2, 3 and 4, the head 14 is provided with a substantially cylindrical seat section 26 at its outer periphery. The seat 26 terminates in a substantially radially extending flange 28 which functions as an abutment to limit the penetration of the head 14 into the sleeve 12, i.e. the flange or abutment 28 engages the end edge 30 of the sleeve 12 as the head is pushed into sleeve 12 to thereby properly relatively positioned the sleeve 12 and head 14.

This abutment flange 28 is provided with a plurality of nicks or cut-outs 32 dividing the flange into a plurality of discrete sections 34. There being 13 such cut-outs or nicks 32 in the arrangement shown in FIG. 2.

The sleeve 12 is provided with a plurality of axially projecting tabs 36. There are being one tab provided for each of the cut-outs 32 so that the head 14 as illustrated (or alternatively head 16), is aligned with the sleeve 12 so that the sleeve 12 may be slid over the shoulder or seat 26 with the projections or tabs 36 projecting through these slots or cut-outs 32 beyond the abutment 28 when the head 14 (or 16) is properly positioned on the sleeve 12. Generally in manufacture the sleeve will be formed into a circular configuration and both heads 14 and 16 inserted substantially simultaneously one into each end of the sleeve.

With the head 14 (and/or 16) in position with all the tabs 36 projecting through their respective cut-outs 32, the tab 36 are folded through an angle $\theta$ (see FIG. 4) of generally at least about 120° to thereby secure the head 14 (or 16) to the sleeve 12. Generally in production the tabs 36 at each end of the sleeve will be folded simultaneously to secure both heads 14 and 16 to the sleeve 12.

With this construction since both of the heads 14 and 16 are secured in substantially the same manner with no spot welding, the head may be pre-coated. For example, the outer face or inner surface of either of the heads 14 or 16 or both may be coated with a suitable coating as indicated schematically at 38 and the tabs 36 crimped to secure the heads 14 and 16 to the sleeve 12 which will have no deleterious effect on this coating as would be the case if a conventional structure were produce utilizing spot welding or the like.

Similarly stainless steel heads may be used with the present invention and no discoloration will occur and the fabricated drum may be used directly.

The present invention also now makes it possible to utilize heads made from suitable plastic materials (such materials are known and need only be selected) i.e. moulded plastic heads may be assembled into drums using the present invention.

Having described the invention, modification will be evident to those skilled in the art without departing from the spirit of the invention as defined in the appended claims.

What I claim as new and desire to secure by Letters Patent of the United States is:

1. A drum for a clothes drier comprising a cylindrical sleeve, a pair of opposed heads position one at each end of said sleeve, each of said heads being provided at its outer periphery with a substantially cylindrical axially extending seat terminating in an outwardly extending abutment means, said seat on each of said heads being received within its respective end of said sleeve and said abutment means limiting penetration of its respective head into said sleeve, axially extending tabs projecting from each end of said sleeve, each of said tabs being bent around its adjacent of said seats on its adjacent of said heads to provide the sole means for securing said heads to said sleeve.

2. The drum structure as defined in claim 1 wherein said abutment means comprises a substantially radially extending flange formed with passages through which said tabs project.

3. The drum structure as defined in claim 1 wherein at least one of said heads is pre-coated with a temperature sensitive coating.

4. The drum structure as defined in claim 1 wherein said sleeve is formed of sheet metal with a crimp longitudinally extending seam joining the side edges of the sheet metal to form the same into said cylindrical sleeve.

5. A drum structure as defined in claim 1 wherein said heads are moulded from suitable plastic materials.

* * * * *